US006050561A

United States Patent [19]

Kidokoro et al.

[11] Patent Number: 6,050,561

[45] Date of Patent: Apr. 18, 2000

[54] SHEET MEDIA INPUT APPARATUS

[75] Inventors: Isao Kidokoro; Mamoru Yamagata, both of Nagano; Tetuji Kawasaki, Tokyo, all of Japan

[73] Assignee: Fuji Electric Co., Ltd., Kawasaki, Japan

[21] Appl. No.: 09/146,137

[22] Filed: Sep. 3, 1998

[30] Foreign Application Priority Data

Sep. 8, 1997 [JP] Japan ..... 9-242899

[51] Int. Cl.[7] ..... B65H 5/00

[52] U.S. Cl. ..... 271/2; 271/10.01; 271/240; 271/253; 271/273; 271/298

[58] Field of Search ..... 271/2, 10.01, 10.09, 271/240, 253, 272, 273, 274, 298, 303

[56] References Cited

U.S. PATENT DOCUMENTS 4,441,704 4/1984 Uchida et al. ..... 271/303
5,067,701 11/1991 Dekker ..... 271/274 X
5,897,114 4/1999 Arikawa et al. ..... 271/272

FOREIGN PATENT DOCUMENTS 8-310672 11/1996 Japan .

*Primary Examiner*—David H. Bollinger
*Attorney, Agent, or Firm*—Kanesaka & Takeuchi

[57] ABSTRACT

An input apparatus of the invention can selectively receive at least one sheet medium or an envelope containing a sheet medium therein. The apparatus includes a transfer path for transferring at least one medium and an envelope, a width guide disposed in the transfer path to restrict a width of the transfer path according to one selection among media input and envelope input, and a separation device situated adjacent to the transfer path. The width guide sets a media transfer width in the transfer path when the media input is selected, and the width guide leaves the transfer path when the envelope input is selected. The separation device transfers the at least one medium and the envelope, and moves in a direction to increase the thickness of the transfer path to allow the envelope to pass through the transfer path when the envelope input is selected.

6 Claims, 5 Drawing Sheets

SHEET MEDIA INPUT APPARATUS

BACKGROUND OF THE INVENTION AND RELATED ART STATEMENT

The present invention relates to a sheet media input apparatus, such as a payment or deposit machine, that is used for receiving both bills and envelopes, which can be made by selecting either batch input in which sheet-type media, in particular, bills are stacked and input, or envelope input in which an envelope containing the media is input.

In Japan, conventional payment machines generally use batch input in which bills are stacked and input in a batch, and except night-time safe, almost all such machines do not use envelope input in which an envelope containing the media is input.

On the other hand, in foreign countries, generally the envelope input is made, and the bill batch input is not made frequently. Since the envelope input method does not register the input money until the contents of the input envelope have been confirmed, a considerable amount of time is required between the input of the envelope and the end of the payment processing. Thus, there arises a demand for the bill batch input.

The introduction of the bill batch input eliminates the needs for envelope input, but all distributed bills are not actually maintained at a level suitable for machine processing (including determination of the genuineness and type of money, and transfer and accommodation of money), and exclusive batch input machines frequently fail to accept faded or damaged bills. Thus, a payment machine that can receive either bill batch input or envelope input by selection is required.

In providing a payment machine that can be used for both bill batch input and envelope input, one problem is that bills and envelopes can not be handled as the same media due to the difference in their sizes and in the function used after they have been received. For example, the width of the bills varies with their types, and a conventional envelope that contains distributed bills of a maximum width (about 90 mm) has a maximum width of 120 mm. Thus, when bills are transferred by using a wide transfer path for envelopes, the positions of the bills are unstable during transfer because they are significantly inclined or displaced to one side of the transfer path, thereby hindering the subsequent processing, including the separation (bills are separated and delivered), identification, transfer, and accommodation of the bills.

This invention is provided in view of these problems and its object is to provide a sheet media batch input apparatus enabling both bill batch input and envelope input.

SUMMARY OF THE INVENTION

To achieve the object, this invention provides a sheet media batch input apparatus for receiving both sheet media and envelopes, which can be made by selecting batch input in which sheet-like media are stacked and input, and envelope input in which an envelope containing the media is input. The apparatus comprises a width guide that restricts a width-wise position in a transfer path through which input media are transferred when the media batch input is selected, while the width guide leaves the transfer path when the envelope input is selected; and media separation means that separates the media transferred to the transfer path before the media are delivered. The media separation means moves in a direction in which the thickness of the transfer path increases in order to allow an envelope to pass when the envelope input is selected.

Since such a media batch input apparatus includes the width guide that restricts the width of the transfer path only during the media batch input, the same transfer path can be used for both envelopes and media. In addition, since the media separation means required for only the media batch input can be moved in the direction in which the thickness of the transfer path increases, a wide and thick transfer path can be formed during the transfer of an envelope by moving the media separation means in the direction in which the thickness of the transfer path increases and moving the width guide for media in the direction leaving the transfer path. This structure enables the apparatus to be used for both media batch and envelope inputs and reduces the size of the apparatus.

DETAILED DESCRIPTION OF A PREFERRED EMBODIMENT

An embodiment of this invention is described in conjunction with an application to a batch input section of a bill and envelope payment machine.

Figure 5:
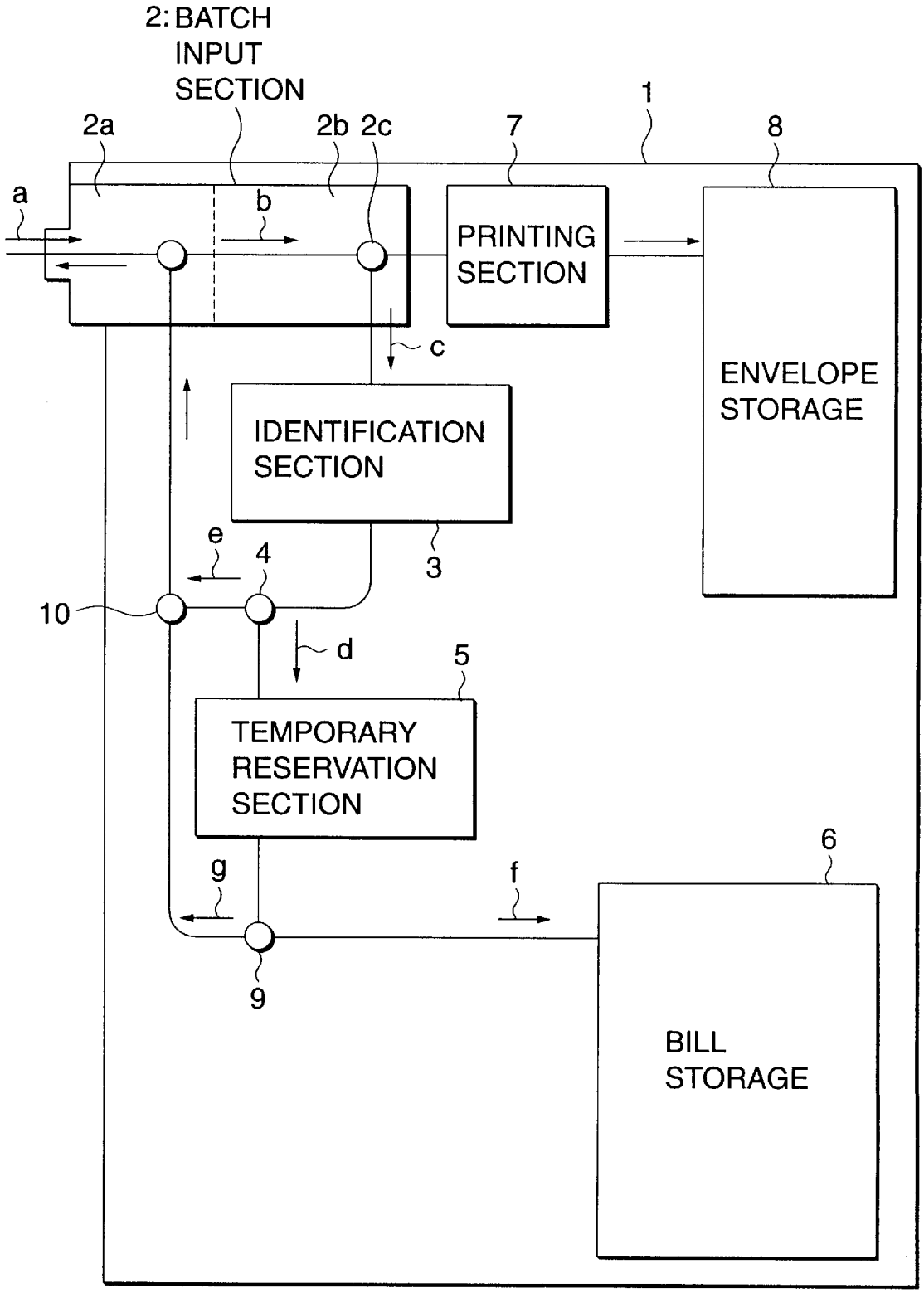
FIG. 5 shows an approximate configuration of a bill and envelope payment machine.

FIG. 5 shows a general structure of a bill and envelope payment machine. In this figure, a payment machine 1 is composed of a batch input section 2; an identification section 3 for determining the type and genuineness of bills; a branching section 4 for switching a bill transfer path based on the results of the determination by the identification section 3; a temporary reservation section 5 for accumulating the bills; a bill storage 6 that accommodates the bills; a printing section 7 for printing the envelopes; an envelope storage 8 that accommodates envelopes; a branching section 9 for switching the bill transfer path in response to an accommodation or a return instruction; and a combining section 10 for returning to the batch input section 2 unidentified bills and those for which a return instruction has been issued. The batch input section 2 is composed of a payment and return section 2*a*, a separation section 2*b* for separating a plurality of input bills before delivering; and a branching section 2*c* for switching between the bill and envelope transfer paths.

The operation of the payment machine 1 of this structure is described by focusing on the flow of bills. When a user selects envelope input by using an input device (not shown), the batch input section 2 forms the envelope transfer path and then enters a standby state. When an envelope is input to the payment and return section 2*a*, the envelope is transferred straight to the printing section 7 by the batch input section 2. Once the printing section 7 has completed printing to the envelope, the envelope is further transferred to the envelope storage 8 for accommodation.

When the bill input is selected, the batch input section 2 forms the bill transfer path and then enters a standby state. When bills are input to the payment and return section 2*a* (arrow (a)), bills are transferred in a batch to the separation section 2*b*. The separation section 2*b* separates the bills before delivering, and the branching section 2*c* then switches the transfer path, through which the bills are transferred to the identification section 3 (arrow (c)). The identification section 3 determines the type and genuineness of the passing bills while counting them. The branching section 4 switches the bill transfer path depending on the result of the determination by the identification section 3. If the result at the identification section 3 is positive, the branching section 4 switches the transfer path to a direction such that the bills enter the temporary reservation section 5 (arrow (d)). Otherwise, the branching section 4 is switched to a direction such that the bills enter the payment and return section 2*a* via the combining section 10 (arrow (e)).

The bills transferred to the temporary reservation section 5 are accumulated, and once a predetermined accumulation operation has been finished, the branching section 9 performs a switching operation according to an instruction from the user. When an accommodation has been indicated, the branching section 9 switches the transfer path to a direction such that the bills enter the bill storage 6 in order to accommodate the accumulated bills in the bill storage 6 in a batch (arrow (f)). When a return has been instructed, the transfer path is switched to a direction such that the bills enter the payment and return section 2*a* via the combining section 10 in order to return the accumulated bills in a batch.

The batch input section according to the embodiment of this invention is now described in detail.

Figure 1:
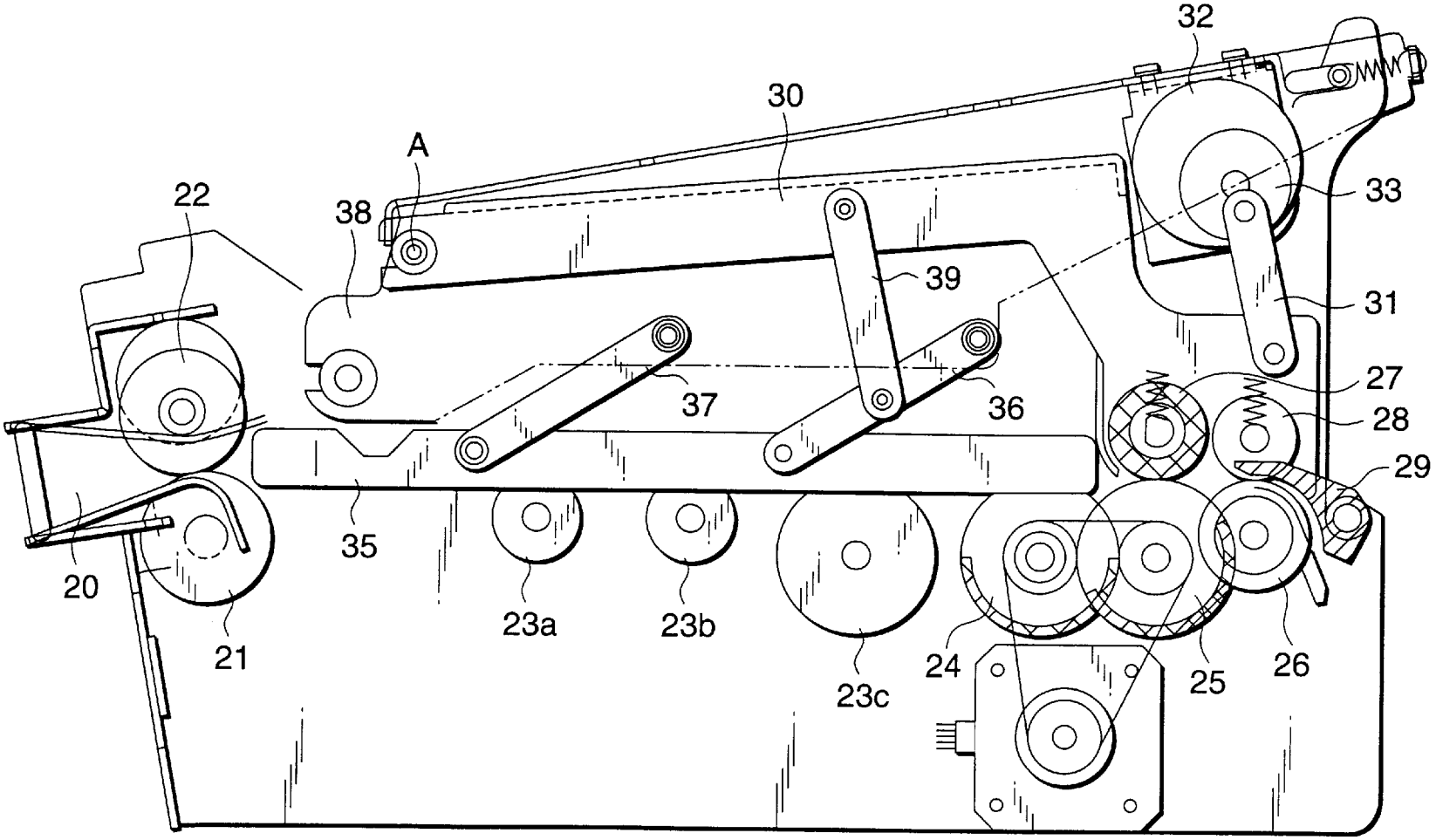
FIG. 1 is a side view of a batch input section of a media input apparatus of the invention.
Figure 2:
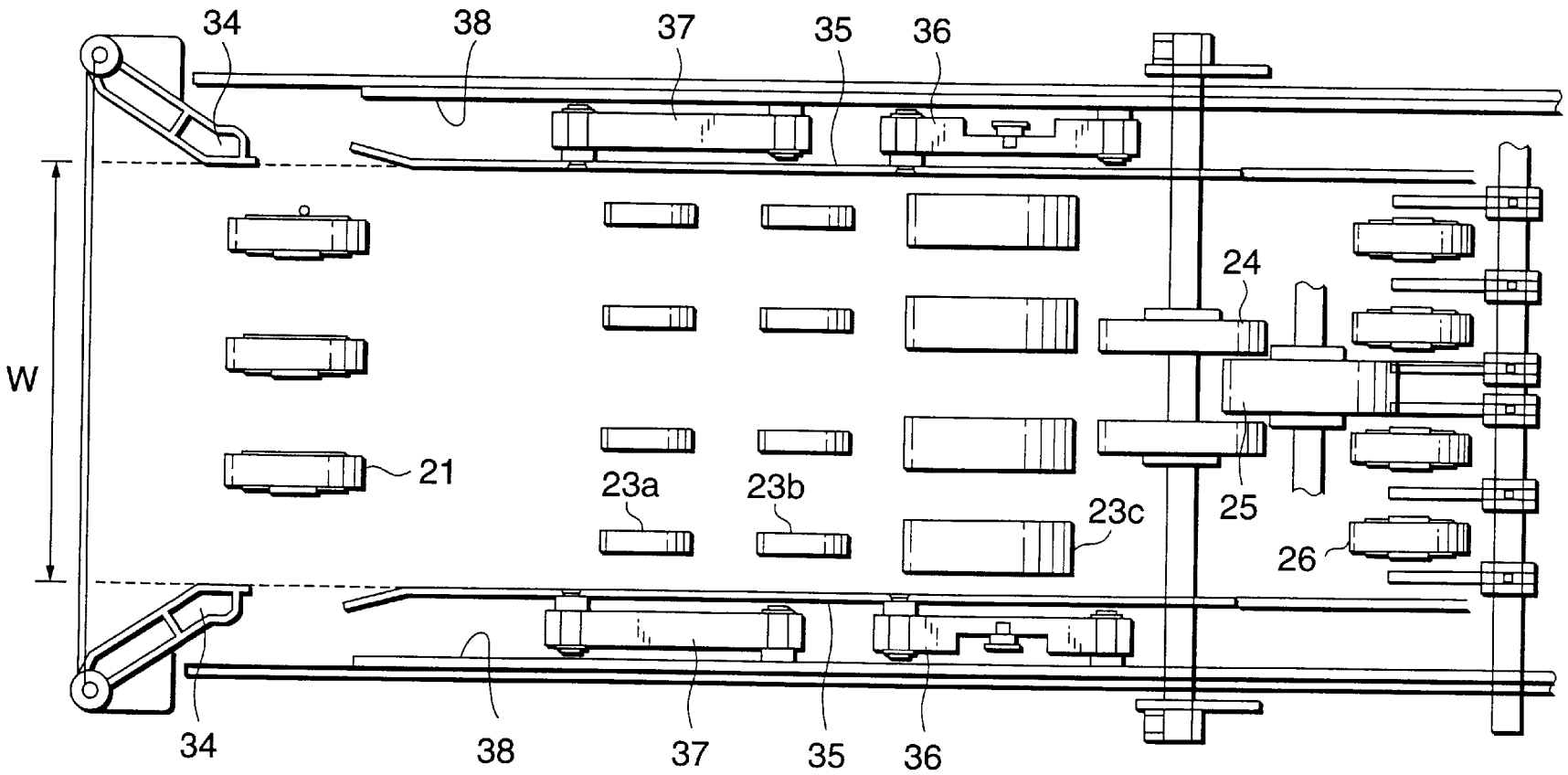
FIG. 2 is a top view of a transfer path in the batch input section.

FIG. 1 is a side view of the batch input section, and FIG. 2 is a top view of the transfer path in the batch input section. In these figures, an input port 20 through which bills or envelopes are input is disposed in the left side of the batch input section, and rollers 21 and 22 for drawing the bills or envelope inwardly are provided on the downstream side of the input port. The batch input section has, on the downstream side of the rollers 21, transfer rollers 23*a*, 23*b* and 23*c* transferig the bills or envelope; kick rollers 24, feed rollers 25 and drawing rollers 26 located on the bottom surface of the transfer path and used to separate the bills respectively; and blocking rollers 27 and presser rollers 28 located on the top surface of the transfer path and used to separate the bills respectively. A gate 29 constituting the branching section 2*c* in FIG. 5 is provided behind the drawing rollers 26 and presser rollers 28.

The blocking rollers 27 and presser rollers 28 are mounted on a movable frame 30 to swing in the vertical direction around a supporting point A as a rotating shaft, wherein the rollers can be moved up and down, and are urged downward by springs. The free end of the movable frame 30 is coupled to a crank 33 of a motor 32 via a link 31. Furthermore, a gate 29 located at the outlet of the batch input section is coupled to the movable frame 30 via a link (not shown) and switches the transfer path in association with the movable frame 30.

As shown in FIG. 2, inlet guides 34 are provided at the respective sides of the input port 20, and a pair of bill width guides 35 for guiding both sides of a transferred bill is located on the downstream side of the rollers 21 and 22. The bill width guides 35 are supported on the fixed frame 38 via two parallel cranks 36 and 37. Furthermore, the parallel cranks 36 are coupled to the movable frame 30 via the links 39.

When the movable frame 30 is in the position shown in FIG. 1, the width of the transfer path is restricted to a bill transfer width W, and the blocking rollers 27 and presser rollers 28 are located so as to contact the feed rollers 25 and drawing rollers 26 located on the bottom surface of the transfer path, thereby allowing the transfer path to be configured for the bill batch input. In this case, the gate 29 coupled to the movable frame 30 via a link (not shown) is in the illustrated turning position.

On the other hand, when the motor 32 makes a half turn, the movable frame 30 is rotated counterclockwise via the link 31 around the supporting point A as a rotating shaft, thereby causing the blocking rollers 27 and presser rollers 28, which are components of the separation mechanism, to be pulled up from their illustrated positions. At the same time, due to the elevation of the movable frame 30, the bill width guides 35 are drawn up via the links 39 and parallel cranks 36 and 37 from the transfer path for the bill batch input while allowing the path to be configured for the envelope input by increasing its width. Furthermore, the gate 29 coupled to the movable frame 30 is driven and rotated to leave the transfer path.

A situation in which the payment mode of the bill and envelope payment machine has been selected for the bill batch input is now described.

Figure 3:
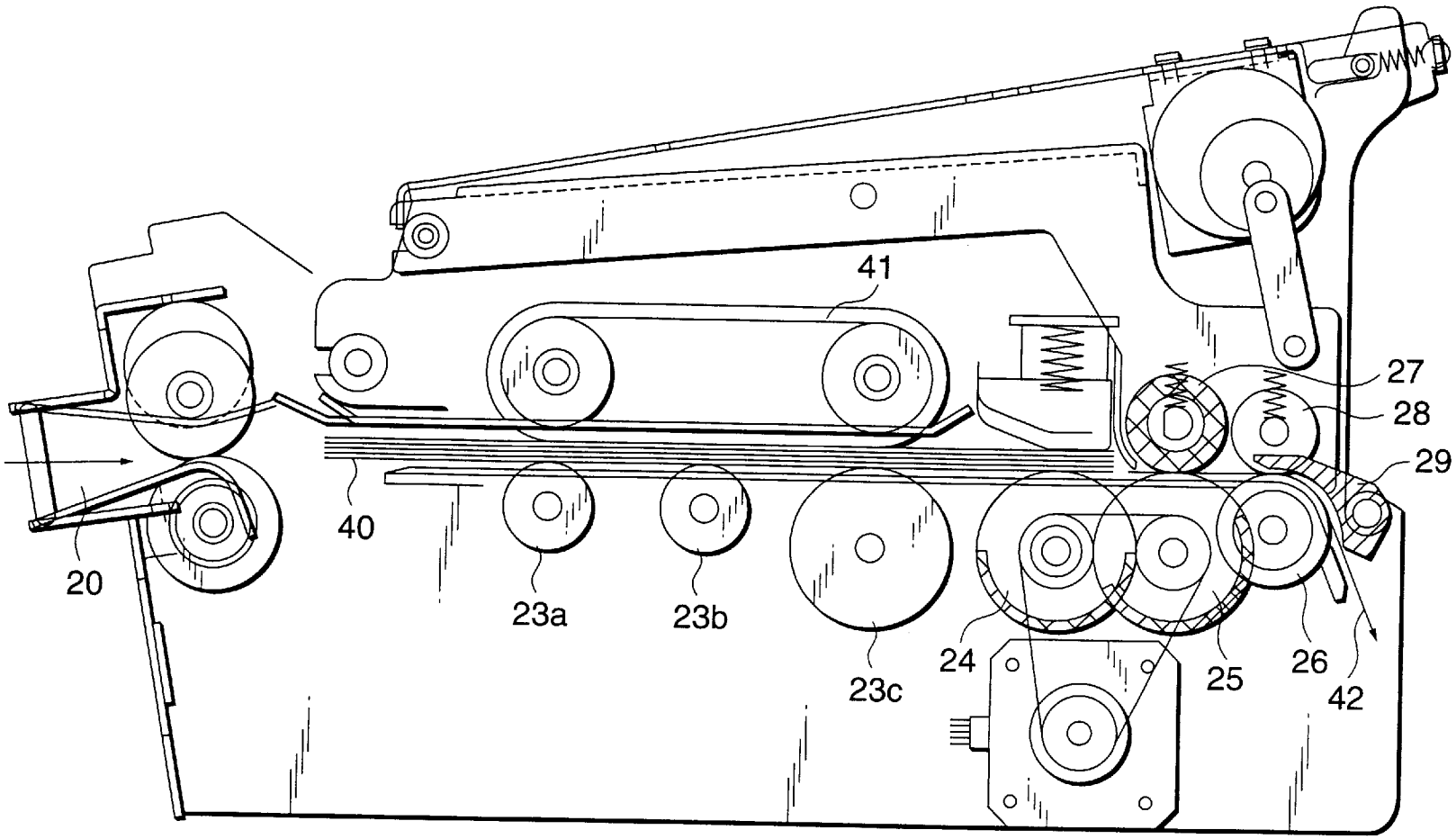
FIG. 3 is a side sectional view of the batch input section describing the operation during bill batch input.

FIG. 3 is a side sectional view of the batch input section describing the operation during the bill batch input. During the bill batch input, the movable frame 30 is lowered to bring the blocking rollers 27 and presser rollers 28 in contact with the feed rollers 25 and drawing rollers 26, respectively, and to place the gate 29 in the illustrated turning position. In addition, the bill width guides 35 are located to the positions at which the guides can restrict the width of the transfer path to the bill transfer width W, as shown in FIG. 2.

When a bunch of bills 40 are input to the input port 20, they are drawn inwardly by the rollers 21 and 22, and are transferred in a batch to the illustrated position using the transfer rollers 23*a*, 23*b* and 23*c* and a transfer belt 41 located on the top surface of the transfer path. Subsequently, the kick rollers 24 are rotated to feed the bills from the bunch of bills 40 starting at the bottom, which are then separated by the feed rollers 25 and blocking rollers 27 and then fed to the drawing rollers 26 and presser rollers 28. The gate then changes the transfer path, and the bills exiting the drawing rollers 26 and presser rollers 28 are fed, in the direction shown by an arrow 42, to the identification section. These operations are repeated until no bills 40 remain.

A situation in which the payment mode of the bill and envelope payment machine has been selected for the envelope input is now described.

Figure 4:
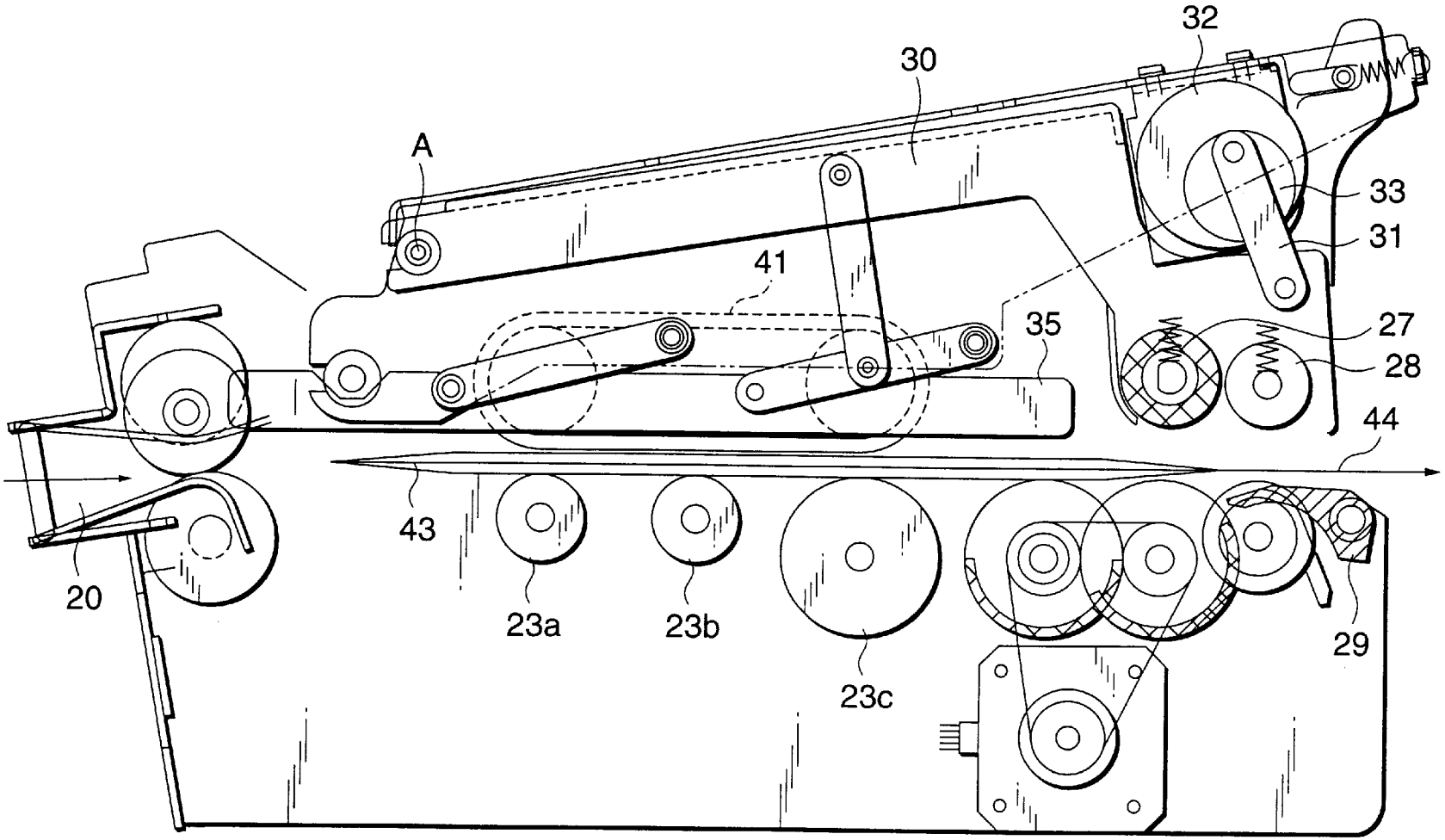
FIG. 4 is a side sectional view of the batch input section describing the operation during envelope input.

FIG. 4 is a side sectional view of the batch input section describing the operation during the envelope input. During the envelope input, the motor 32 causes the crank 33 to make a half turn. This causes the movable frame 30 to be rotated around the supporting point A as a rotating shaft. The blocking rollers 27 and presser rollers 28, which are components of the separation mechanism, are then pulled up, causing the gate 29 to leave the transfer path by which an envelope advances linearly. In addition, the elevation of the movable frame 30 causes the bill width guides 35 to be drawn up, thereby allowing the path to be configured for envelopes by increasing its width.

When an envelope 43 is input to the input port 20, it is drawn inwardly by the rollers 21 and 22, and is transferred by the transfer rollers 23*a*, 23*b* and 23*c* and the transfer belt 41 in a direction shown by an arrow 44 to the printing section.

As described above, in this invention, the bill separating mechanism section is formed to have two vertical units so that during the envelope input, an upper unit is moved to widen the transfer path in the direction of the thickness of the envelope while the bill width guides are simultaneously allowed to leave the transfer path to widen the path in the width direction. This configuration enables the same input port and transfer path to be used for both bill batch input and envelope input, in which bills are placed in an envelope, thereby providing the batch input apparatus for both bills and envelopes that only uses nearly the same space as in the envelope input machine exclusively.

What is claimed is:

1. An input apparatus for selectively receiving at least one medium and an envelope containing a medium therein, comprising:

a transfer path for transferring at least one medium and an envelope, a width guide movably disposed in the transfer path to restrict a width of the transfer path according to one selection among media input and envelope input, said width guide having a width substantially same as a media transfer width to set the media transfer width in the transfer path when the media input is selected, and being movable to leave the transfer path when the envelope input is selected; and separation means situated adjacent to the transfer path, said separation means transferring the at least one medium and the envelope and moving in a direction to increase a thickness of the transfer path to allow the envelope to pass through the transfer path when the envelope input is selected.

2. An input apparatus according to claim 1, wherein said separation means includes a fixed unit having a first transfer mechanism for transferring the at least one medium and the envelope; and a movable unit including a second transfer mechanism facing the first transfer mechanism, said movable unit being movable in a direction to leave the fixed unit when the envelope input is selected.

3. An input apparatus according to claim 2, wherein the movable unit of the separation means is connected to the width guide to move the width guide, said movable unit moving in association with an operation of said width guide restricting the transfer path to the transfer width and leaving the transfer path.

4. An input apparatus according to claim 2, wherein said first transfer mechanism includes at least one kick roller, at least one feed roller and at least one drawing roller; and the second transfer mechanism includes at least one blocking roller opposed to the at least one feed roller and at least one presser roller opposed to the at least one drawing roller.

5. An input apparatus according to claim 1, further comprising a gate located on a downstream side of the separation means, said gate switching an outlet of the transfer path depending on the selection of the media input and envelope input.

6. An input apparatus according to claim 1, wherein said at least one medium includes sheet-type media stacked together, and the envelope contains sheet-type media therein.

* * * * *